US010047638B2

(12) United States Patent
Adachi et al.

(10) Patent No.: US 10,047,638 B2
(45) Date of Patent: Aug. 14, 2018

(54) HEAT ENERGY RECOVERY SYSTEM

(71) Applicants: Kobe Steel, Ltd., Hyogo (JP); ASAHI SHIPPING CO., LTD., Tokyo (JP); TSUNEISHI SHIPBUILDING Co., Ltd., Hiroshima (JP); MIURA Co., Ltd., Ehime (JP)

(72) Inventors: Shigeto Adachi, Takasago (JP); Yutaka Narukawa, Takasago (JP); Tetsuro Fujii, Tokyo (JP); Kazuya Arahira, Tokyo (JP); Masakazu Yamamoto, Hiroshima (JP); Yutaka Kobayashi, Hiroshima (JP); Toshio Sageshima, Hiroshima (JP)

(73) Assignees: Kobe Steel, Ltd., Hyogo (JP); ASAHI SHIPPING CO., LTD., Tokyo (JP); TSUNEISHI SHIPBUILDING Co., Ltd., Hiroshima (JP); MIURA Co., Ltd., Ehime (JP)

( * ) Notice: Subject to any disclaimer, the term of this patent is extended or adjusted under 35 U.S.C. 154(b) by 91 days.

(21) Appl. No.: 15/088,454

(22) Filed: Apr. 1, 2016

(65) Prior Publication Data

US 2016/0298497 A1 Oct. 13, 2016

(30) Foreign Application Priority Data

Apr. 9, 2015 (JP) ..... 2015-080238

(51) Int. Cl.
*F02B 33/44* (2006.01)
*F02B 43/00* (2006.01)
(Continued)

(52) U.S. Cl.
CPC ..... *F01K 13/02* (2013.01); *F01K 15/045* (2013.01); *F01K 23/10* (2013.01)

(58) Field of Classification Search
CPC ..... F01K 23/10; F01K 13/02; F01K 15/045
(Continued)

(56) References Cited

U.S. PATENT DOCUMENTS 4,099,374 A * 7/1978 Foster-Pegg ..... F01K 23/067 60/39.12
5,715,682 A * 2/1998 Nakata ..... F01K 3/247 60/649
(Continued)

FOREIGN PATENT DOCUMENTS

CN 103534445 A 1/2014
CN 104185718 A 12/2014
(Continued)

OTHER PUBLICATIONS

The extended European search report issued by the European Patent Office dated Oct. 14, 2016, which corresponds to European Patent Application No. 16159195.3-1610 and is related to U.S. Appl. No. 15/088,454.

*Primary Examiner* — Thai Ba Trieu
(74) *Attorney, Agent, or Firm* — Studebaker & Brackett PC

(57) ABSTRACT

Disclosed is a heat energy recovery system including: a heat energy recovery circuit that causes a working medium to circulate by means of a circulation pump to exchange heat with supercharged air from a supercharger via a first heater and exchange heat with steam from an exhaust-gas economizer via a second heater, in order to integrally drive a turbine and a generator; and a controller that performs stop control to stop the circulation pump based on the flow state of the steam in a first steam flow path that causes the steam to flow from the exhaust-gas economizer to a soot blower.

19 Claims, 8 Drawing Sheets

1: HEAT ENERGY RECOVERY SYSTEM 10: HEAT ENERGY RECOVERY CIRCUIT 11: CIRCULATION PUMP 12: FIRST HEATER
13: SECOND HEATER 15: TURBINE 16: GENERATOR 19: CONTROLLER 32: SUPERCHARGER
40: EXHAUST-GAS ECONOMIZER 42: FIRST STEAM FLOW PATH 50: SOOT BLOWER 31: INTERNAL COMBUSTION ENGINE

(51) Int. Cl.

| | |
|---|---|
| ***F01K 13/00*** | (2006.01) |
| ***F01K 23/06*** | (2006.01) |
| ***F01K 13/02*** | (2006.01) |
| ***F01K 15/04*** | (2006.01) |
| ***F01K 23/10*** | (2006.01) |

(58) Field of Classification Search
USPC ..... 60/618, 670, 645, 39.12
See application file for complete search history.

(56) References Cited

U.S. PATENT DOCUMENTS

| | | | | |
|---|---|---|---|---|
| 6,128,895 | A | 10/2000 | Takahama et al. | |
| 2011/0270451 | A1* | 11/2011 | Sakaguchi | F01K 13/02 700/288 |
| 2013/0118168 | A1* | 5/2013 | Ichiki | F01K 23/10 60/645 |
| 2013/0327133 | A1 | 12/2013 | Yamashita | |
| 2015/0218972 | A1 | 8/2015 | Ono | |
| 2016/0251991 | A1* | 9/2016 | Randall | B01D 53/14 60/282 |

FOREIGN PATENT DOCUMENTS

| | | | | | |
|---|---|---|---|---|---|
| EP | 2615264 | A1 | | 7/2013 | |
| JP | 58123022 | A | * | 7/1983 | F23L 15/02 |
| JP | 2008-255959 | A | | 10/2008 | |
| JP | 2012-202262 | A | | 10/2012 | |
| JP | 2012215081 | A | * | 11/2012 | F01K 23/10 |
| JP | 2013-180625 | A | | 9/2013 | |
| JP | 2014-194216 | A | | 10/2014 | |
| WO | 2011/089997 | A1 | | 7/2011 | |

* cited by examiner

HEAT ENERGY RECOVERY SYSTEM

TECHNICAL FIELD

The present invention relates to a heat energy recovery system that recovers the heat energy of a heating medium via a working medium.

BACKGROUND ART

Conventionally, there have been known apparatuses that recover heat energy generated by internal combustion engines for ships. As an example of such apparatuses, an exhaust-heat recovery-type ship propulsion apparatus disclosed in Japanese Unexamined Patent Publication No. 2013-180625 has an exhaust-heat recovery power-generation system with a first cycle that causes an organic fluid to circulate through a high-pressure evaporator, a power turbine for power generation, and a condenser in this order by means of a first circulation pump and a second cycle that causes the organic fluid to circulate through a low-pressure evaporator, the power turbine, and the condenser in this order by means of a second circulation pump. The low-pressure evaporator heats the organic fluid from the second circulation pump with jacket cooling water used to cool the jacket of a diesel engine, and the high-pressure evaporator heats the organic fluid from the first circulation pump by heat exchange between steam supplied from an exhaust-gas economizer and exhaust gas from the diesel engine. In the exhaust-heat recovery power-generation system, a generator connected to the power turbine generates power when the power turbine is driven to rotate based on the heat drop of the organic fluid evaporated by the low-pressure evaporator and the heat drop of the organic fluid evaporated by the high-pressure evaporator.

Meanwhile, the steam generated by the exhaust-gas economizer is preferentially supplied to a destination that demands the steam, other than the exhaust-heat recovery power-generation system, in a ship, e.g., a soot blower or the like that cleans a ballast tank, a cargo room, a deck, or the like. Thus, a supply amount of the steam from the exhaust-gas economizer to the evaporator of the exhaust-heat recovery power-generation system, i.e., a heat energy recovery system decreases, which results in a likelihood that the organic fluid is supplied to the power turbine without being substantially heated. Therefore, in such a case, an operator performs a stop operation to stop the operation of the heat energy recovery system.

However, it is difficult for the operator to perform the stop operation of the heat energy recovery system at an appropriate timing, and there is also a possibility of the operator forgetting to stop the operation of the heat energy recovery system.

SUMMARY OF INVENTION

It is a principal object of the present invention to reliably stop the operation of a heat energy recovery system at an appropriate timing.

An aspect of the present invention provides a heat energy recovery system that is installed in a ship and recovers heat energy of supercharged air from a supercharger of an internal combustion engine via a working medium while recovering heat energy of steam from an economizer via the working medium under a condition in which the steam is preferentially supplied to a destination that demands the steam in the ship, the heat energy recovery system including:

a heat energy recovery circuit having a closed-type medium circulation path in which a first heater that heats the working medium by heat exchange between the supercharged air and the working medium, a second heater that is connected in series to the first heater and heats the working medium by heat exchange between the steam from the economizer and the working medium, an expander that generates power based on expansion of the working medium heated by the first heater and the second heater, a condenser that condenses the working medium flowing out from the expander, and a pump that conveys the working medium from the condenser are connected in sequence; a power recovery machine that is connected to the expander and recovers the power of the expander; a first steam flow path that causes the steam to flow from the economizer to the destination that demands the steam; a second steam flow path that branches off from the first steam flow path and causes the steam to flow from the economizer to the second heater; and a controller that performs stop control to stop an operation of the pump based on at least one of a flow state of the steam in the first steam flow path and a flow state of the steam in the second steam flow path.

DESCRIPTION OF EMBODIMENTS

Hereinafter, a description will be given of the embodiments of the present invention with reference to the accompanying drawings. Note that the following embodiments describe only a materialized example of the present invention and do not intend to limit the technical scope of the present invention.

First Embodiment

Hereinafter, a description will be given of the first embodiment of a heat energy recovery system with reference to the drawings. Note that the heat energy recovery system of the embodiment is a binary power generation system that recovers the heat energy of exhaust gas from a supercharger-equipped diesel engine serving as the propulsion internal combustion engine of a ship and the heat energy of supercharged air from a supercharger to generate power.

Figure 1:
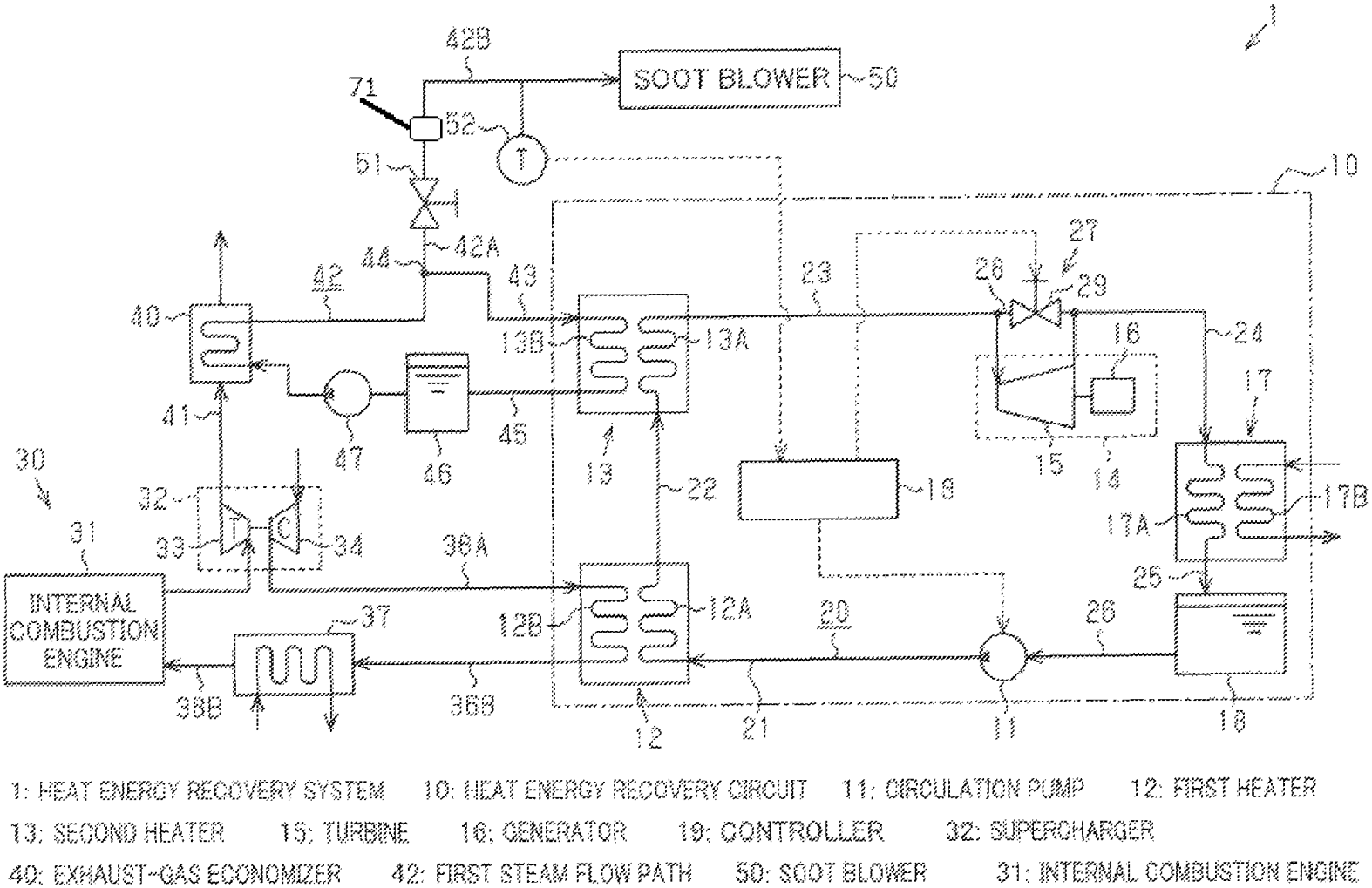
FIG. 1 is a schematic configuration diagram showing the system configuration of the heat energy recovery system of a first embodiment.

As shown in FIG. 1, a heat energy recovery system 1 has a heat energy recovery circuit 10 including a closed-type medium circulation path 20 in which a circulation pump 11, a first heater 12, a second heater 13, a power generation unit 14, a condenser 17, and a reservoir tank 18 are connected in sequence and into which a working medium flows. The heat energy recovery circuit 10 is an organic Rankine cycle heat engine in which a chlorofluorocarbon-based medium such as R245fa is, e.g., used as the working medium.

In the heat energy recovery system 1, supercharged air from a supercharger 32 of the supercharger-equipped diesel engine 30 is supplied to the first heater 12, and steam from an exhaust-gas economizer 40 that generates the steam with exhaust gas from the internal combustion engine 31 is supplied to the second heater 13. Thus, the supercharged air and the steam and the working medium exchange heat whereby heat energy is recovered.

The medium circulation path 20 connects the respective equipment to each other with a first pipe 21 to a sixth pipe 26 so as to cause the working medium ejected from the circulation pump 11 to be sucked in the circulation pump 11 again via the respective equipment of the heat energy recovery circuit 10. Specifically, the first pipe 21 compels the circulation pump 11 and the first heater 12 to each other, a second pipe 22 connects the first heater 12 and the second heater 13 to each other, and a third pipe 23 connects the second heater 13 and the power generation unit 14 to each other. In addition, a fourth pipe 24 connects the power generation unit 14 and the condenser 17 to each other, a fifth pipe 25 connects the condenser 17 and the reservoir tank 18 to each other, and the sixth pipe 26 connects the reservoir tank 18 and the circulation pump 11 to each other.

The circulation pump 11 is, e.g., an electric pump and supplies the working medium of the reservoir tank 18 to the first heater 12.

The first heater 12 is a shell-and-tube-type heat exchanger and has a first flow path 12A into which the working medium from the circulation pump 11 flows and a second flow path 12B into which the supercharged air from the supercharger 32 flows. In the first heater 12, the working medium-flowing into the first-flow path 12A and the supercharged air flowing into the second flow path 12B exchange heat with each other.

The second heater 13 is a shell-and-tube-type heat exchanger and has a first flow path 13A into which the working medium from the first heater 12 flows and a second flow path 13B into which the steam from the exhaust-gas economizer 40 flows. In the second heater 13, the working medium flowing into the first flow path 13A and the steam flowing into the second flow path 13B exchange heat with each other.

The power generation unit 14 has a configuration in which a screw-type turbine 15 showing an example of an expander and a generator 16 showing an example of a power recovery machine that generates power with the rotation of the turbine 15 are accommodated in a common housing (not shown). The turbine 15 is driven to rotate based on a difference in pressure between the working medium flowing from the second heater 13 via the third pipe 23 and the working medium flowing toward the condenser 17 via the fourth pipe 24. Note that another displacement-type turbine such as a scroll-type turbine or a non-displacement-type turbine such as a centrifugal-type gas turbine may be used as the turbine 15.

The condenser 17 has a first flow path 17A into which the working medium from the power generation unit 14 flows and a second flow path 17B into which cooling water from a cooling-water tank (not shown) flows. In the condenser 17, the working medium flowing into the first flow path 17A and the cooling water flowing into the second flow path 17B exchange heat with each other.

The reservoir tank 18 stores the working medium cooled by the condenser 17 and supplies the working medium to the circulation pump 11 with the operation of the circulation pump 11.

In addition, the heat energy recovery system 1 has a detouring unit 27 that causes the working medium to detour around the power generation unit 14 and flow into the condenser 17. The detouring unit 27 has a bypass 28 that connects the third pipe 23 and the fourth pipe 24 to each other while skipping the power generation unit 14 and has a bypass valve 29 that switches between the flow and the interruption of the working medium in the bypass 28. When the bypass valve 29 is closed, the working medium from the third pipe 23 flows into the turbine 15 of the power generation unit 14. On the other hand, when the bypass valve 29 is opened, the working medium from the third pipe 23 flews into the fourth pipe 24 via the bypass 28. That is, the working medium does not flow into the turbine 15.

Next, a description will be given of the connection configuration between the heat energy recovery circuit 10, the supercharger-equipped diesel engine 30, the exhaust-gas economizer 40, and the like.

A turbine 33 of the supercharger 32 connected to the exhaust side of the internal combustion engine 31 of the supercharger-equipped diesel engine 30 is connected to the exhaust-gas economizer 40 via an exhaust pipe 41. On the other hand, a compressor 34 of the supercharger 32 is connected to the first heater 12 via a first scavenging pipe 36A. The first heater 12 is connected to the intake side of the internal combustion engine 31 via a second scavenging pipe 36B and an air cooler 37 provided in the middle of the second scavenging pipe 36B.

The exhaust-gas economizer 40 is connected via a first steam flow path 42 to a soot blower 50 showing an example of a destination that demands steam in a ship. The soot blower 50 is an apparatus that cleans a ballast tank, a cargo room, a deck, or the like using the steam from the exhaust-gas economizer 40. In addition, the exhaust-gas economizer 40 is connected to the second heater 13 via a second steam flow path 43 that branches off from the first steam flow path 42 at a branch point 44 provided in the middle of the first steam flow path 42. Therefore, the whole of the steam from the exhaust-gas economizer 40 flows into one of the soot blower 50 and the second heater 13. Accordingly, the sum of the amount of the steam supplied to the soot blower 50 and the amount of the steam supplied to the second heater 13 becomes uniform unless the amount of the steam generated by the exhaust-gas economizer 40 changes.

On the downstream side with respect to the branch point 44 in the first steam flow path 42, a soot blow valve 51 is provided. The soot blow valve 51 is an on-off valve that switches between the flow and the interruption of the steam from a primary-side flow path 42A that serves as a flow path on the upstream side with respect to the soot blow valve 51 (on the side of the exhaust-gas economizer 40) in the first steam flow path 42 to a secondary-side flow path 42B that serves as a flow path on the downstream side with respect to the soot blow valve 51 (on the side of the soot blower 50) in the first steam flow path 42.

In the secondary-side flow path 42B on the downstream side with respect to the soot blow valve 51, a temperature sensor 52 showing an example of a temperature detection unit that detects a temperature of the steam in the secondary-side flow path 42B is provided to grasp the amount of the steam as an index of the flow state of the steam in the first steam flow path 42.

In addition, the exhaust-gas economizer 40 is connected to the second heater 13 via a return path 45. That is, condensed water generated when the latent heat of the steam from the exhaust-gas economizer 40 is recovered by the second heater 13 returns to the exhaust-gas economizer 40 via the return path 45. In the middle of the return path 45, a reservoir tank 46 that stores the condensed water and an ejection pump 47 that supplies the condensed water of the reservoir tank 46 to the exhaust-gas economizer 40 are provided.

The heat energy recovery system 1 thus configured generates power by causing the working medium to flow as follows to recover the heat energy of the supercharged air from the supercharger 32 and the steam from the exhaust-gas economizer 40 as electric energy.

The liquefied working medium of the reservoir tank 18 is supplied to the circulation pump 11 via the sixth pipe 26 with the operation of the circulation pump 11, while the working medium is supplied to the first heater 12 via the first pipe 21. The working medium having flown into the first heater 12 exchanges heat with the high-temperature supercharged air of the supercharger 32 that is driven with operation of the internal combustion engine 31 to be heated and evaporated. The working medium evaporated by the first heater 12 is supplied to the second heater 13 via the second pipe 22. Then, the working medium having flown into the second heater 13 exchanges heat with the high-temperature steam from the exhaust-gas economizer 40 to be further heated, and then is supplied to the turbine 15 of the power generation unit 14 via the third pipe 23. Then, the turbine 15 rotates based on a difference in pressure between the working medium flowing from the third pipe 23 and the working medium flowing into the fourth pipe 24. Thus, the rotor of the generator 16 connected to the turbine 15 rotates with respect to the armature of the generator 16 to generate power. The working medium flowing out from the turbine 15 to the fourth pipe 24 is supplied to the condenser 17 while having been brought into a low-pressure state by the turbine 15. Then, the working medium having flown into the condenser 17 is cooled and liquefied by the cooling water and flows into the reservoir tank 18 via the fifth pipe 25. When the above circulation of the working medium is repeatedly performed, the power generation unit 14 is driven and generates power. That is, the heat energy recovery system 1 performs the recovery of the heat energy.

In addition, the heat energy recovery system 1 has a controller 19 that controls the operations of the circulation pump 11 and the power generation unit 14 to realize the above circulation of the working medium. The controller 19 is constituted by a CPU, a ROM, a RAM, or the like and controls the operations of the circulation pump 11 and the power generation unit 14 based on a control program stored in the ROM or the RAM. In addition, a signal detected by the temperature sensor 52 is input to the controller 19.

When there is a need to stop the heat energy recovery system 1, the controller 19 performs stop control to stop the operation of the circulation pump 11 based on a flow state of the steam from the exhaust-gas economizer 40 and open the bypass valve 29. In addition, when there is a need to resume the power generation of the heat energy recovery system 1 in a state in which the operation of the circulation pump 11 has been stopped and the bypass valve 29 is opened, the controller 19 performs resumption control to resume the operation of the circulation pump 11 based on a flow state of the steam from the exhaust-gas economizer 40 and close the bypass valve 29.

A description will be given of the details of the stop control together with its function.

Although the exhaust-gas economizer 40 is capable of supplying steam to both the second heater 13 and the soot blower 50, it originally intends to supply the steam to the soot blower 50. Therefore, since the exhaust-gas economizer 40 heats the second heater 13 with the steam when the soot blower 50 is not driven, it supplies the steam to the soot blower 50 preferentially to the second heater 13. Therefore, when the steam from the exhaust-gas economizer 40 is supplied to the soot blower 50, a surplus of the steam supplied to the second heater 13 via the second steam flow path 43 decreases, which results in a likelihood that the working medium flowing into the second heater 13 may not be substantially heated.

Then, when the working medium is not substantially heated by the second heater 13, the turbine 15 of the power generation unit 14 may not substantially secure a difference in pressure between the working medium flowing into the turbine 15 and the working medium flowing out from the turbine 15. As a result, there is a likelihood that the power generation efficiency of the generator 16 reduces and by extension the rotation of the turbine 15 stops even when the working medium is supplied to the turbine 15.

Therefore, when the steam from the exhaust-gas economizer 40 is not substantially supplied to the second heater 13, i.e., when the steam from the exhaust-gas economizer 40 is preferentially supplied to the soot blower 50, it is preferable to stop the power generation of the heat energy recovery system 1.

In order to stop the power generation of the heat energy recovery system 1 as described above, there is a need to grasp the situation that the steam from the exhaust-gas economizer 40 is preferentially supplied to the soot blower 50. Further, the situation that the steam is preferentially supplied to the soot blower 50 is grasped based on the following principle.

Since the steam from the exhaust-gas economizer 40 has a high temperature, a temperature inside the first steam flow path 42 increases when the steam flows into the first steam flow path 42 connected to the soot blower 50. This temperature becomes higher as the amount of the steam flowing into the first steam flow path 42 increases when the steam starts flowing into the first steam flow path 42. Therefore, the secondary-side flow path 42B temperature increases as the amount of the steam in the secondary-side flow path 42B increases when the steam starts flowing into the secondary-side flow path 42B. Further, in a state in which the steam has substantially flown into the secondary-side flow path 42B, the steam in the secondary-side flow path 42B is maintained at a temperature higher than its temperature before flowing into the secondary-side flow path 42B. Accordingly, the situation that the soot blow valve 51 is opened and the steam from the exhaust-gas economizer 40 is preferentially supplied to the soot blower 50 may be grasped by the secondary-side flow path 42B on the downstream side with respect to the soot blow valve 51 has a high temperature.

Figure 2:
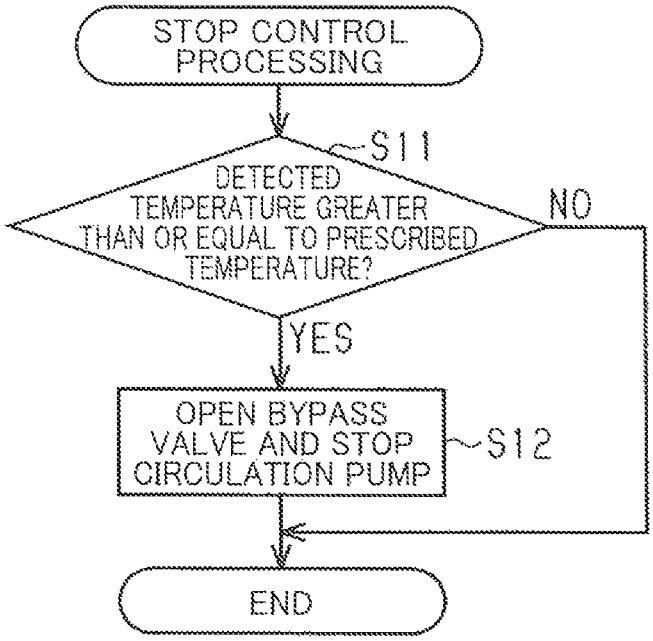
FIG. 2 is a flowchart showing the procedure of stop control processing performed by the controller of the heat energy recovery system of the first embodiment.

Based on the above idea, the controller 19 determines in the stop control whether to stop the operation of the circulation pump 11 and open the bypass valve 29 according to a temperature of the steam in the secondary-side flow path 42B as shown in the flowchart of FIG. 2. Note that the controller 19 repeatedly performs the stop control every prescribed time in a state in which the circulation pump 11 operates and the bypass valve 29 is closed.

As shown in FIG. 2, the controller 19 first determines in step S11 whether a temperature detected by the temperature sensor 52 showing a temperature of the steam in the secondary-side flow path 42B is greater than or equal to a prescribed temperature.

Here, the prescribed temperature represents a temperature of the steam in the secondary-side flow path 42B when the steam from the exhaust-gas economizer 40 is preferentially supplied to the soot blower 50, e.g., the lower limit of the temperature of the steam in the secondary-side flow path 42B when the soot blower 50 is used. This prescribed temperature is set in advance according to an examination or the like.

Then, when determining that the detected temperature is greater than or equal to the prescribed temperature (step S11: YES), i.e., when determining that the steam from the exhaust-gas economizer 40 is preferentially supplied to the soot blower 50, the controller 19 opens the bypass valve 29 and stops the operation of the circulation pump 11 in step S12. Thus, the power generation of the heat energy recovery system 1 is stopped.

On the other hand, when determining that the detected temperature is less than the prescribed temperature (step S11: NO), i.e., when determining that the steam from the exhaust-gas economizer 40 is not supplied preferentially to the spot blower 50, the controller 19 temporarily stops the processing while maintaining the operation of the circulation pump 11 and the closed state of the bypass valve 29. That is, the power generation of the heat energy recovery system 1 is maintained.

Next, a description will be given of the details of the resumption control together with its function.

It is predicted that the steam from the exhaust-gas economizer 40 is supplied to the second heater 13 rather than being supplied to the soot blower 50 when the steam from the exhaust-gas economizer 40 is not supplied to the soot blower 50 in the stop control. Further, provided that the working medium is capable of being substantially heated by the second heater 13, a reduction in the power generation efficiency of the generator 16 and the stop of the rotation of the turbine 15 regardless of the supply of the working medium to the turbine 15 are prevented even when the heat energy recovery system 1 resumes power generation.

In addition, as described above, whether the steam from the exhaust-gas economizer 40 is preferentially supplied to the soot blower 50 based on a temperature detected by the temperature sensor 52 can be grasped. Therefore, the situation that the steam from the exhaust-gas economizer 40 is hardly supplied to the second heater 13 when the steam from the exhaust-gas economizer 40 is preferentially supplied to the soot blower 50 may be grasped. On the other hand, the situation that the steam is preferentially supplied to the second heater 13 when the steam from the exhaust-gas economizer 40 is not supplied preferentially to the soot blower 50 may be grasped. Accordingly, whether the steam from the exhaust-gas economizer 40 is preferentially supplied to the second heater 13 based on a temperature detected by the temperature sensor 52 can be determined.

In addition, when a long time elapses after the stop control, i.e., when, the power generation of the heat energy recovery system 1 is stopped for a long time, a lubricant (e.g., oil) for smoothly rotating the rotor of the turbine 15 and the rotor of the generator 16 has a low temperature and high viscosity. When the rotor of the turbine 15 and the rotor of the generator 16 are driven in this state, there is a likelihood that the heat energy recovery system 1 is not allowed to efficiently perform the power generation due to the mechanical losses of the rotors. Therefore, it is preferable to perform a warm-up to apply the heat of the working medium, which is obtained by causing the working medium to detour around the power generation unit 14 with the detouring unit 27 to be circulated and then heating the working medium with the respective heater 12 and 13, to the turbine 15 and the generator 16 with the circulation pump 11 in the medium circulation path 20.

Based on the above matters, the controller 19 switches from the stop control to the resumption control after confirming the situation that the steam from the exhaust-gas economizer 40 is preferentially supplied to the second heater 13 and the working medium and the lubricant of the power generation unit 14 are substantially heated by the second heater 13.

Figure 3:
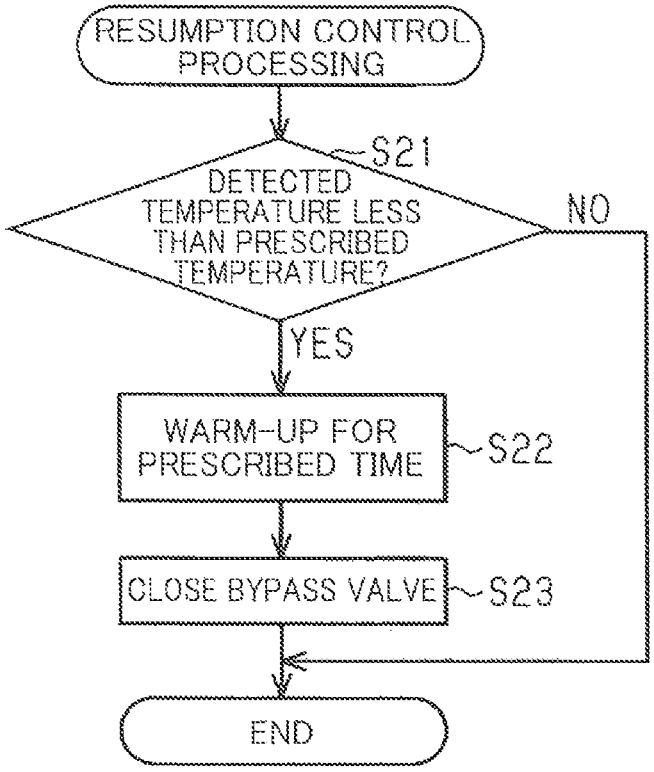
FIG. 3 is a flowchart showing the procedure of resumption control processing performed by the controller of the heat energy recovery system of the first embodiment.

As shown in the flowchart of FIG. 3, the controller 19 first determines in step S21 whether a temperature detected by the temperature sensor 52 is less than a prescribed temperature. When determining that the detected temperature is less than the prescribed temperature (step S21: YES), i.e., when determining that the steam from the exhaust-gas economizer 40 is not supplied preferentially to the soot blower 50, the controller 19 resumes the operation of the circulation pump 11 to perform the warm-up for a prescribed time (step S22) and then closes the bypass valve 29 (step S23). Thus, the power generation of the heat energy recovery system 1 is resumed.

Note that the prescribed time represents a time until the viscosity of the lubricant supplied to the power generation unit 14 by the second heater 13 and the working medium reaches viscosity at which the rotor of the turbine 15 and the rotor of the generator 16 do not reduce their rotation performance in the warm-up, and is set in advance according to an examination or the like. In addition, the prescribed time is measured by a timer (not shown) inside the controller 19, and the measurement starts when it is determined that the temperature detected by the temperature sensor 52 is less than the prescribed temperature.

On the other hand, when determining that the detected temperature is greater than or equal to the prescribed temperature (step S21: NO), i.e., when determining that the steam from the exhaust-gas economizer 40 is preferentially supplied to the soot blower 50, the controller 19 temporarily stops the processing in a state in which the operation of the circulation pump 11 is kept stopped and the opened state of the bypass valve 29 is maintained. That is, the power generation of the heat energy recovery system 1 does not resume.

According to the heat energy recovery system 1 of the embodiment, the following effects are obtained.

(1) The controller 19 performs the stop control based on a temperature of the steam in the secondary-side flow path 42B of the first steam flow path 42 showing a temperature detected by the temperature sensor 52. Thus, when the steam from the exhaust-gas economizer 40 is hardly supplied to the second heater 13, i.e., when the power generation efficiency of the heat energy recovery system 1 is reduced, the operation of the circulation pump 11 is stopped automatically, and the power generation of the heat energy recovery system 1 is stopped. Accordingly, an operator has no need to manually stop the power generation of the heat energy recovery system 1. Thus, it can be stopped the power generation of the heat energy recovery system 1 at an appropriate timing without relying upon the manual operation of the operator.

(2) In addition, the controller 19 may appropriately grasp the situation that the steam from the exhaust-gas economizer 40 is preferentially supplied to the soot blower 50 based on a temperature detected by the temperature sensor 52. Then, the controller 19 may stop the power generation of the heat energy recovery system 1 based on the grasped flow state of the steam. Accordingly, it can be stopped the power generation of the heat energy recovery system 1 at an appropriate timing.

(3) The controller 19 performs the resumption control based on a temperature detected by the temperature sensor 52. Therefore, the controller 19 may resume the operation of the stopped circulation pump 11 after grasping the situation that the soot blower 50 does not need the steam from the exhaust-gas economizer 40 based on the detected temperature. Thus, it can be resumed that the power generation of the heat energy recovery system 1 at an appropriate timing without relying upon the manual operation of an operator and can be prevented that an unnecessary reduction in the power generation efficiency of the heat energy recovery system 1 caused when the operator forgets to perform the resumption operation of the heat energy recovery system 1 or the operator inadvertently delays in performing the resumption operation.

(4) When the steam from the exhaust-gas economizer 40 is supplied to the second heater 13, the second heater 13 recovers the latent heat of the steam. Then, condensed water ejected from the second heater 13 returns to the exhaust-gas economizer 40 via the return path 45. Thus, an atmos condenser is not needed, and the simplification of the configuration of the heat energy recovery system 1 may be attained.

(5) The heat energy recovery system 1 has the detouring unit 27. Therefore, in the resumption control, the heat energy recovery system 1 may realize the warm-up of the power generation unit 14 via the detouring unit 27 without driving the turbine 15 to rotate. In addition, since the working medium is caused to flow while detouring around the power generation unit 14 by the detouring unit 27 and thus the pressure loss of the working medium reduces when the working medium flows into the medium circulation path 20, the ejection pressure of the circulation pump 11 reduces. Therefore, it may be reduced that the consumption energy of the circulation pump 11 when the working medium is caused to detour around the power generation unit 14 by the detouring unit 27 at the time of the warm-up.

Second Embodiment

A description will be given of the configuration of a heat energy recovery system 1 of a second embodiment with reference to FIGS. 4 to 6. Note that the constituents of the heat energy recovery system 1 of the second embodiment, which are the same as those of the heat energy recovery system 1 of the first embodiment, will be denoted by the same symbols and their descriptions will be partially or entirely omitted.

Figure 4:
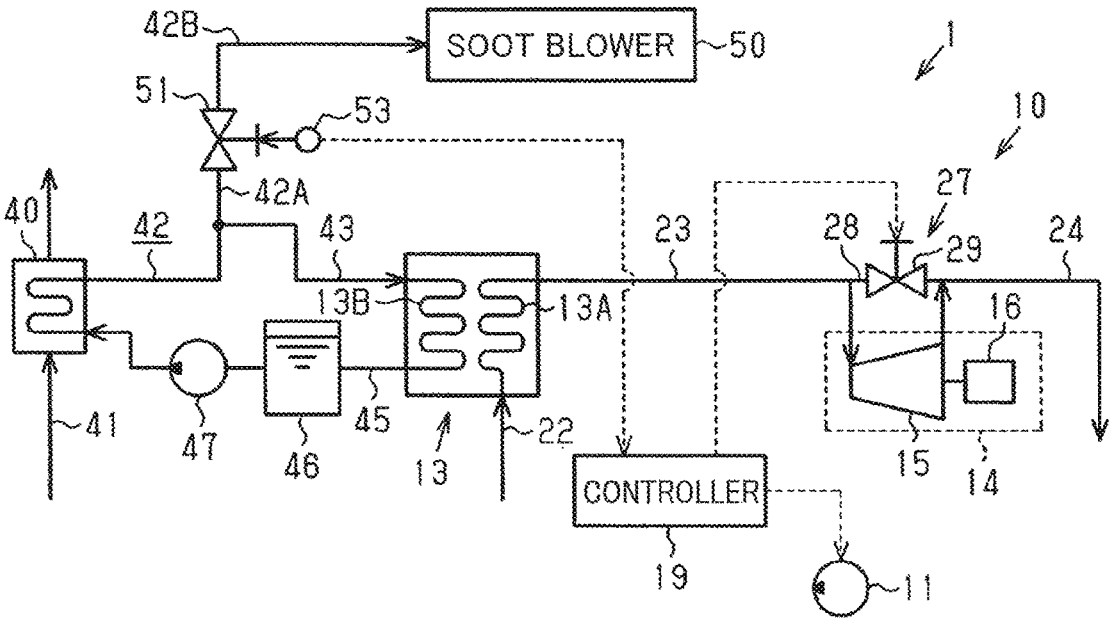
FIG. 4 is a schematic configuration diagram showing a part of the system configuration of the heat energy recovery system of a second embodiment.

As shown in FIG. 4, the heat energy recovery system 1 of the embodiment differs from the heat energy recovery system 1 of the first embodiment in that it does not have a temperature sensor 52 that detects a temperature of a secondary-side flow path 42B and has a limit switch 53 showing an example of a valve detection unit that detects the opened state and the closed state of a soot blow valve 51. The limit switch 53 is provided inside the soot blow valve 51 and outputs an on-off signal according to the on-off operation of the soot blow valve 51 to a controller 19.

Next, a description will be given of the details of stop control and resumption control.

Steam from an exhaust-gas economizer 40 is preferentially supplied to a soot blower 50 than to a second heater 13. Therefore, the steam is preferentially supplied from the exhaust-gas economizer 40 to the soot blower 50 when the soot blow valve 51 is opened.

In addition, the soot blow valve 51 is closed when the soot blower 50 does not need the steam from the exhaust-gas economizer 40. As described above, it can be determined whether the soot blower 50 needs the steam from the exhaust-gas economizer 40 based on the opened state and the closed state of the soot blow valve 51.

Figure 5:
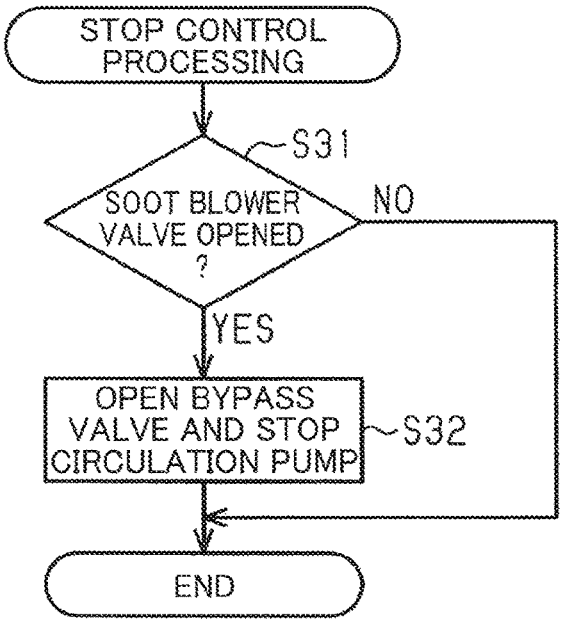
FIG. 5 is a flowchart showing the procedure of stop control processing performed by the controller of the heat energy recovery system of the second embodiment.
Figure 6:
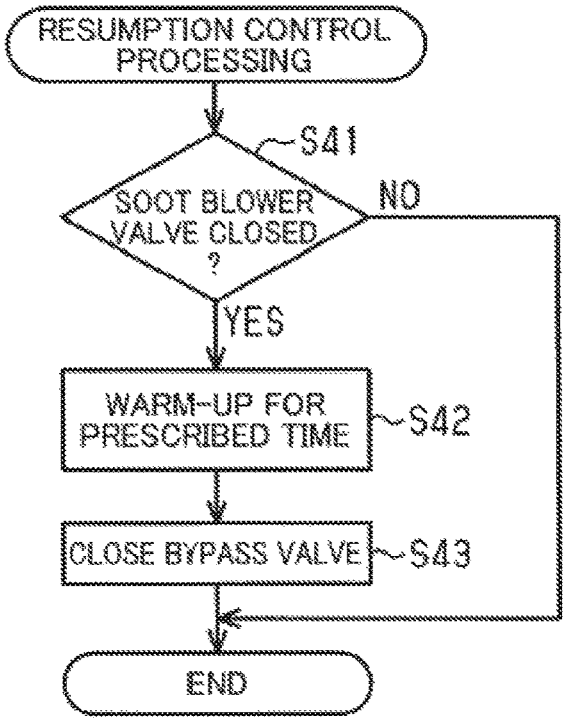
FIG. 6 is a flowchart showing the procedure of resumption control processing performed by the controller of the heat energy recovery system of the second embodiment.

In view of this, as shown in the flowcharts of FIGS. 5 and 6, the controller 19 performs the stop control and the resumption control based on the opened state and the closed state of the soot blow valve 51 instead of a temperature detected by the temperature sensor 52 of the first embodiment.

In stop control processing shown in FIG. 5, the controller 19 first determines in step S31 whether the soot blow valve 51 is opened. The determination is made based on the on-off signal of the limit switch 53.

When determining that the soot blow valve 51 is opened (step S31: YES), the controller 19 opens a bypass valve 29 and stops the operation of a circulation pump 11 in step S32. Thus, the power generation of the heat energy recovery system 1 is stopped.

On the other hand, when determining that the soot blow valve 51 is closed (step S31: NO), the controller 19 temporarily stops the processing while maintaining the operation of the circulation pump 11 and the closed state of the bypass valve 29. That is, the power generation of the heat energy recovery system 1 is maintained.

In resumption control processing shown in FIG. 6, the controller 19 first determines in step S41 whether the soot blow valve 51 is closed. When determining that the soot blow valve 51 is closed (step S41: YES), the controller 19 resumes the operation of the circulation pump 11 to perform a warm-up for a prescribed time (step S42) and then closes the bypass valve 29 (step S43). Thus, the power generation of the heat energy recovery system 1 is resumed.

On the other hand, when determining that the soot blow valve 51 is opened (step S41: NO), the controller 19 temporarily stops the processing while maintaining the stop of the operation of the circulation pump 11 and the opened state of the bypass valve 29. That is, the power generation of the heat energy recovery system 1 does not resume.

As described above, according to the heat energy recovery system 1 of the embodiment, effects equivalent to the effects (1) to (3) of the first embodiment besides the effects (4) and (5) of the first embodiment may be obtained.

Third Embodiment

A description will be given of the configuration of a heat energy recovery system 1 of a third embodiment with reference to FIGS. 7 to 9. Note that the constituents of the heat energy recovery system 1 of the third embodiment, which are the same as those of the heat energy recovery system 1 of the first embodiment, will be denoted by the same symbols and their descriptions will be partially or entirely omitted.

Figure 7:
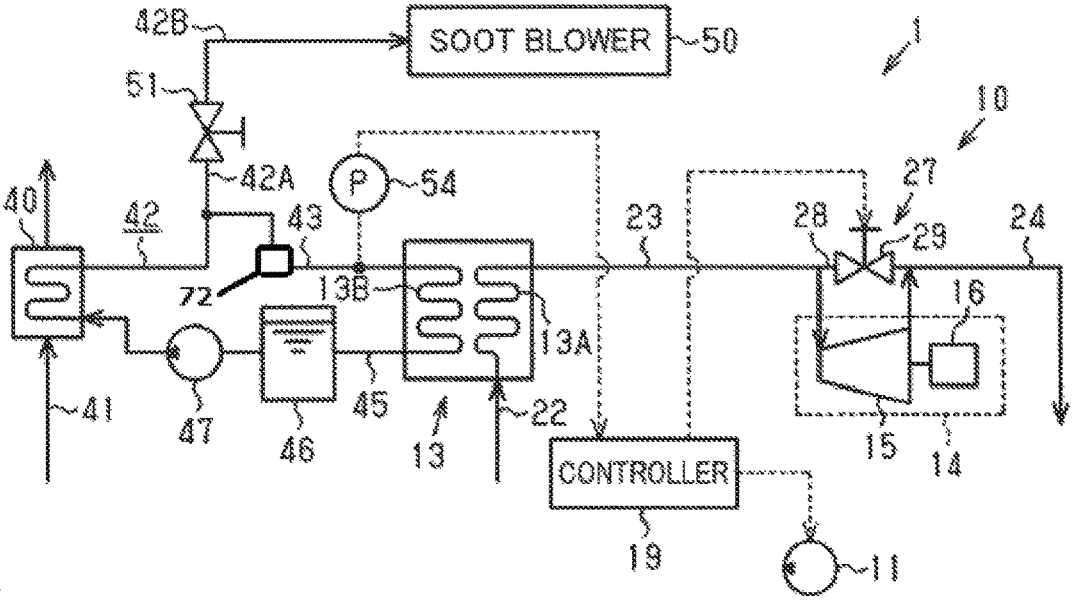
FIG. 7 is a schematic configuration diagram showing a part of the system configuration of the heat energy recovery system of a third embodiment.

As shown in FIG. 7, the heat energy recovery system 1 of the embodiment differs from the heat energy recovery system 1 of the first embodiment in that it does not have a temperature sensor 52 that detects a temperature of a secondary-side flow path 42B and has a pressure sensor 54 showing an example of a pressure detection unit in a second steam flow path 43. The pressure sensor 54 detects pressure of steam in the second steam flow path 43 and outputs the detected pressure showing the detection result to a controller 19 as a pressure signal.

Next, a description will be given of the details of stop control and resumption control.

Pressure of the steam in the second steam flaw path 43 tends to become higher as a flow rate of the steam in the second steam flow path 43, i.e., a supply amount of the steam from an exhaust-gas economizer 40 to a second heater 13 increases when the steam from the exhaust-gas economizer 40 starts flowing into the second steam flow path 43. Further, in a state in which the steam has substantially flown into the second steam flow path 43, the steam in the second steam flow path 43 is maintained at pressure higher than its pressure before flowing into the second steam flow path 43. Moreover, when an internal combustion engine 31 (see FIG. 1) has a constant load, a flow rate of the steam in the secondary-side flow path 42B of a first steam flow path 42 decreases as a flow rate of the steam in the second steam flow path 43 increases.

Therefore, based on pressure of the steam in the second steam flow path 43, it can be grasped that a flow rate of the steam in the second steam flow path 43 and a flow rate of the steam in the secondary-side flow path 42B of the first steam flow path 42. Therefore, it can be determined whether the steam from the exhaust-gas economizer 40 is preferentially supplied to a soot blower 50. Based on this, it can be determined whether there is a need to stop the power generation of the heat energy recovery system 1, and can be determined whether the soot blower 50 does not need the steam when the heat energy recovery system 1 has been stopped.

Figure 8:
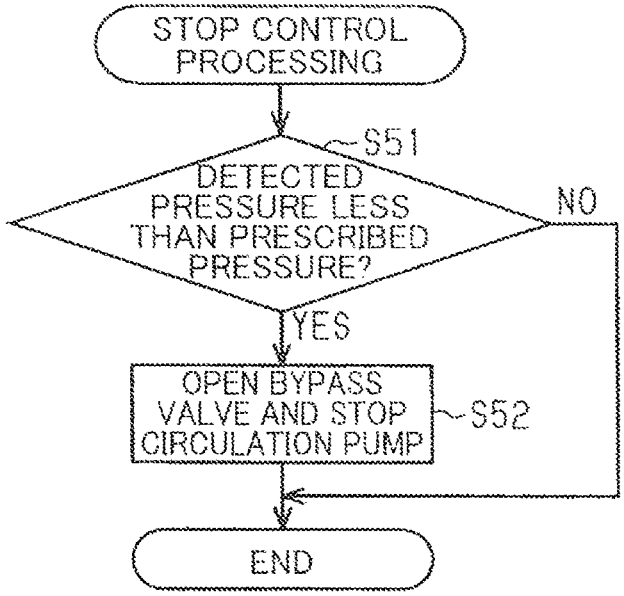
FIG. 8 is a flowchart showing the procedure of stop control processing performed by the controller of the heat energy recovery system of the third embodiment.
Figure 9:
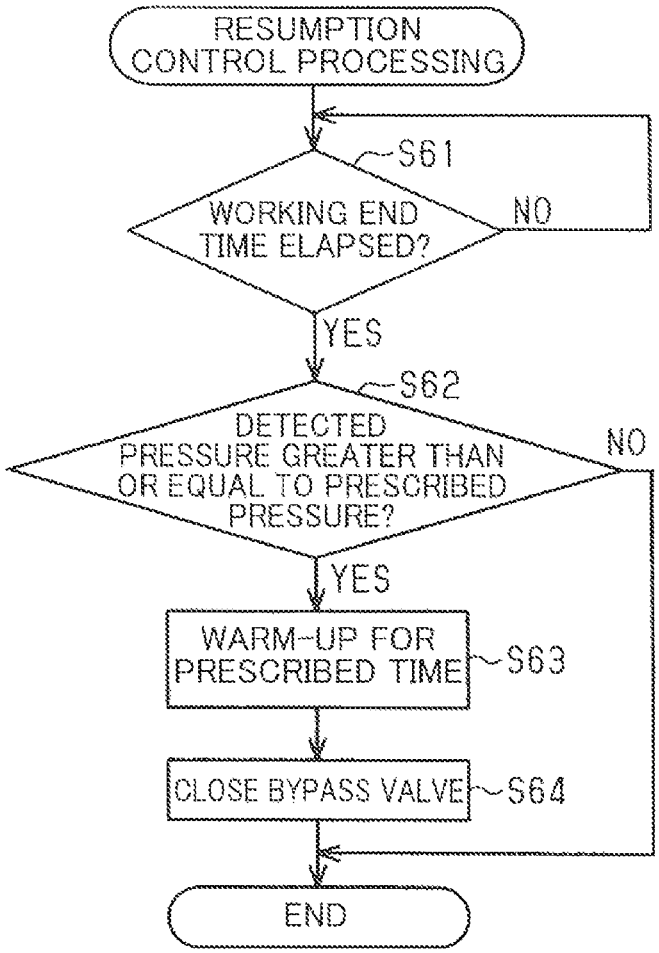
FIG. 9 is a flowchart showing the procedure of resumption control processing performed by the controller of the heat energy recovery system of the third embodiment.

Accordingly, as shown in the flowcharts of FIGS. 8 and 9, the controller 19 performs the stop control and the resumption control based on pressure of the steam in the second steam flow path 43 instead of a temperature detected by the temperature sensor 52 of the first embodiment.

In stop control processing shown in FIG. 8, the controller 19 first determines in step S51 whether pressure of the steam in the second steam flow path 43, i.e., pressure detected by the pressure sensor 54 is less than prescribed pressure.

Here, the prescribed pressure represents pressure of the steam in the second steam flow path 43 when the steam from the exhaust-gas economizer 40 is preferentially supplied to the soot blower 50, e.g., the lower-limit value of the pressure of the steam in the second steam flow path 43 when the soot blower 50 is used. The prescribed pressure is set in advance according to an examination or the like.

When determining that the detected pressure is less than the prescribed pressure (step S51: YES), i.e., when determining that the steam from the exhaust-gas economizer 40 is preferentially supplied to the soot blower 50, the controller 19 opens a bypass valve 29 and stops the operation of a circulation pump 11 in step S52. Thus, the power generation of the heat energy recovery system 1 is stopped.

On the other hand, when determining that the detected pressure is greater than or equal to the prescribed pressure (step S51: NO), i.e., when determining that the steam from the exhaust-gas economizer 40 is not supplied preferentially to the soot blower 50, the controller 19 temporarily stops the processing while maintaining the operation of the circulation pump 11 and the closed state of the bypass valve 29. That is, the power generation of the heat energy recovery system 1 is maintained.

In resumption control processing shown in FIG. 9, the controller 19 first determines in step S61 whether a working end time has elapsed. Note that the working end time represents, e.g., a working time for cleaning by the soot blower 50 and is set in advance. In addition, a timer provided in the controller 19 starts measuring the working end time when the controller 19 starts the stop control.

When determining that the working end time has not elapsed (step S61: NO), the controller 19 returns to the determination in step S61. On the other hand, when determining that the working end lime has elapsed (step S61: YES), the controller 19 determines in step S62 whether pressure detected by the pressure sensor 54 is greater than or equal to prescribed pressure.

When determining that the detected pressure is greater than or equal to the prescribed pressure (step S62: YES), the controller 19 resumes the operation of the circulation pump 11 to perform a warm-up for a prescribed time (step S63) and then closes the bypass valve 29 (step S64). Thus, the power generation of the heat energy recovery system 1 is resumed.

On the other hand, when determining that the detected pressure is less than the prescribed pressure (step S62: NO), the controller 19 temporarily stops the processing while keeping the operation of the circulation pump 11 stopped and maintaining the opened state of the bypass valve 29. That is, the power generation of the heat energy recovery system 1 does not resume.

According to the heat energy recovery system 1 of the embodiment, the following effects besides the effects (4) and (5) of the first embodiment and an effect equivalent to the effect (1) of the first embodiment may be obtained.

(6) The controller 19 performs the stop control based on pressure detected by the pressure sensor 54 that detects pressure of the steam in the second steam flow path 43. Thus, by grasping the flow state of the steam in the second steam flow path 43 and the flow state of the steam in the first steam flow path 42 based on the detected pressure, the controller 19 may stop the power generation of the heat energy recovery system 1 through grasping the situation that the steam from the exhaust-gas economizer 40 is preferentially supplied to the soot blower 50. Accordingly, the power generation of the heat energy recovery system 1 can be stopped at an appropriate timing.

(7) The controller 19 performs the resumption control based on pressured detected by the pressure sensor 54. Thus, the controller 19 may resume the operation of the stopped circulation pump 11 after appropriately grasping the situation that the soot blower 50 does not need the steam based on the detected pressure. Thus, it can be resumed the power generation of the heat energy recovery system 1 at an appropriate timing without relying upon the manual operation of an operator and can be prevented an unnecessary reduction in the power generation efficiency of the heat energy recovery system 1 caused whets the operator forgets to perform the resumption operation of the heat energy recovery system 1 or the operator inadvertently delays in performing the resumption operation.

Fourth Embodiment

A description will be given of the configuration of a heat energy recovery system 1 of a fourth embodiment with reference to FIGS. 10 and 11. The heat energy recovery system 1 of the fourth embodiment differs from the heat energy recovery system 1 of the first embodiment in that a controller 19 performs stop control and resumption control based on a load of an internal combustion engine 31.

A description will be given of the details of the stop control and the resumption control.

As described in the first embodiment, steam supplied from an exhaust-gas economizer 40 to a second heater 13 decreases when the steam is supplied from the exhaust-gas economizer 40 to a soot blower 50 on a large scale. Therefore, an increasing amount of the temperature of a working medium in the second heater 13 reduces. Even in this case, supercharged pressure of a supercharger 32 becomes high and a temperature of supercharged air becomes high when the internal combustion engine 31 has a high load. Therefore, the first heater 12 may substantially increase the temperature of the working medium with the heat of the high-temperature supercharged air, whereby the power generation of a generator 16 can be expected.

Therefore, since the heat energy recovery system 1 is capable of substantially generating power with the generator 16 when the internal combustion engine 31 has a high load, there is no need to stop the heat energy recovery system 1. In view of this, a controller 19 invalidates the stop control when the internal combustion engine 31 has a high load. On the other hand, the controller 19 performs the resumption control when the internal combustion engine 31 has a high load during the stop control. The specific procedure of the processing will be described below.

Figure 10:
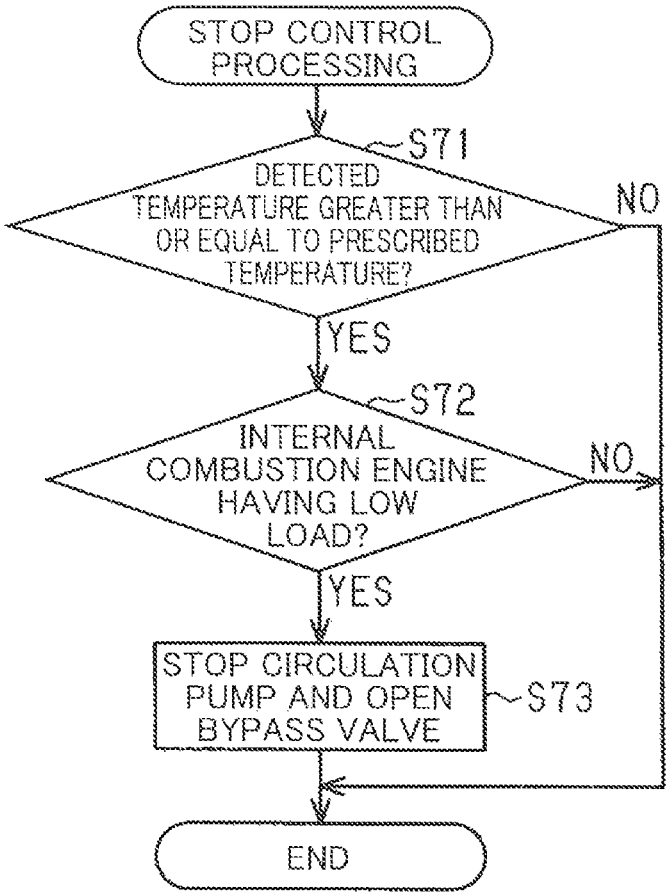
FIG. 10 is a flowchart showing the procedure of stop control processing performed by the controller of the heat energy recovery system of a fourth embodiment.

In stop control processing shown in FIG. 10, when determining in step S71 corresponding to step S11 of the first embodiment that a temperature detected by a temperature sensor 52 is greater than or equal to a prescribed temperature (step S71: YES), the controller 19 determines in step S72 whether the internal combustion engine 31 has a low load.

Here, the controller 19 determines that the internal combustion engine 31 has a low load when the load of the internal combustion engine 31 is less than a setting load at which the internal combustion engine 31 may be determined to have a high load. The setting load represents a load of the internal combustion engine 31 at which a temperature of the working medium, which is heated when supercharged air from the supercharger 32 driven with the operation of the internal combustion engine 31 exchanges heat with the working medium in the first heater 12, becomes greater than or equal to a temperature at which the power generation of a power generation unit 14 can be expected. The setting load is set in advance according to an examination or the like. As an example, the setting load is at 60% of the rated load of the internal combustion engine 31.

When determining that the internal combustion engine 31 has a low load (step S72: YES), the controller 19 opens a bypass valve 29 and stops the operation of a circulation pump 11 in step S73. Thus, the power generation of the heat energy recovery system 1 is stopped.

On the other hand, when determining that the internal combustion engine 31 does not have a low load (step S72: NO), i.e., when determining that the internal combustion engine 31 has a high load, the controller 19 temporarily stops the processing while maintaining the operation of the circulation pump 11 and the closed state of the bypass valve 29. That is, the power generation of the heat energy recovery system 1 does not stop.

Figure 11:
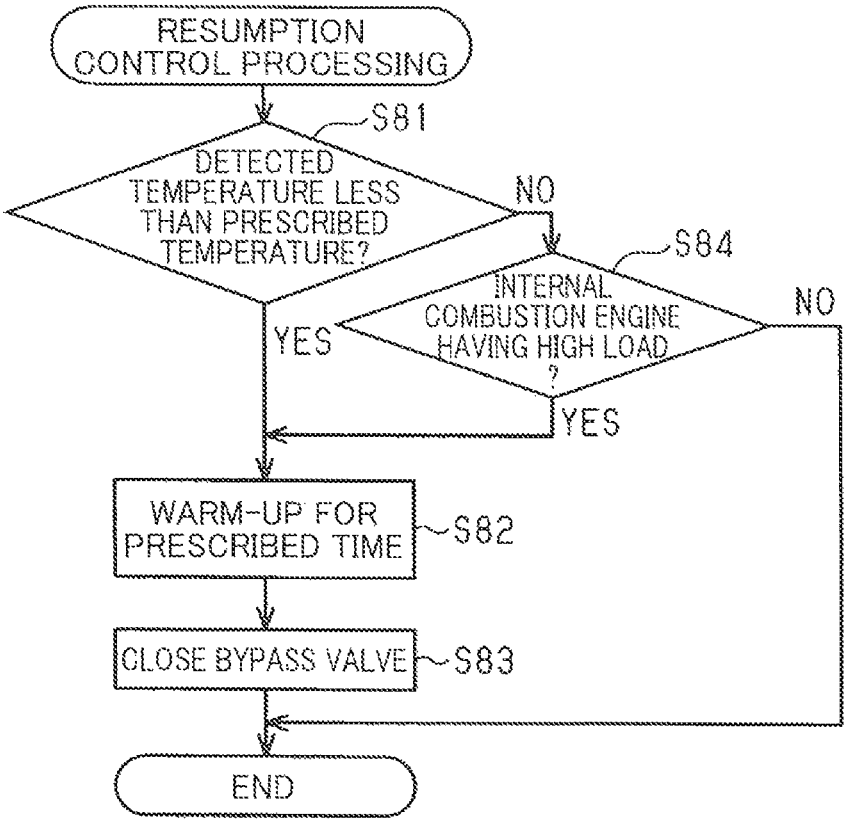
FIG. 11 is a flowchart showing the procedure of resumption control processing performed by the controller of the heat energy recovery system of the fourth embodiment.

In resumption control processing shown in FIG. 11, the fourth embodiment differs from the first embodiment in processing procedure when the controller 19 determines in step S81 corresponding to step S21 of the first embodiment that a temperature detected by the temperature sensor 52 is greater than or equal to a prescribed temperature (step S81: NO). That is, when determining that the detected temperature is greater than or equal to the prescribed temperature, the controller 19 determines in step S84 whether the internal combustion engine 31 has a high load. Note that it is determined that the internal combustion engine 31 has a high load when the load of the internal combustion engine 31 is greater than or equal to a setting load.

Then, when determining that the internal combustion engine 31 has a high load (step S84: YES), the controller 19 performs a warm-up for a prescribed time in step S82 and closes the bypass valve 29 in step S83. Thus, the power generation of the heat energy recovery system 1 is resumed.

On the other hand, when determining that the internal combustion engine 31 does not have a high load (step S84: NO), the controller 19 temporarily stops the processing while maintaining the stop of the circulation pump 11 and the opened state of the bypass valve 29. That is, the power generation of the heat energy recovery system 1 does not resume.

According to the heat energy recovery system 1 of the embodiment, the following effect besides the effects (1) to (5) of the first embodiment may be obtained.

(8) The controller 19 invalidates the stop control when the internal combustion engine 31 has a high load. Therefore, an unnecessary reduction in the power generation efficiency of the heat energy recovery system 1 can be prevented.

Modified Examples

The above descriptions of the respective embodiments exemplify modes that may be employed by a heat energy recovery system according to the present invention and do not intend to limit the modes. The heat energy recovery system according to the present invention may employ, e.g., modified examples of the respective embodiments that will be described below and modes in which at least two modified examples not contradictory to each other are combined together.

In the first embodiment, a pressure sensor or a flow-rate sensor 71 may be provided in the secondary-side flow path 42B instead of the temperature sensor 32. With a pressure sensor provided in the secondary-side flow path 42B, it may be grasped the flow state of the steam in the secondary-side flow path 42B and by extension may indirectly be grasped the supply state of the steam from the exhaust-gas economizer 40 to the soot blower 50 based on pressure detected by the pressure sensor. Thus, the controller 19 may perform the stop control and the resumption control based on the pressure (detected pressure) of the secondary-side flow path 42B. Then, the controller 19 replaces the content of step S11 in the stop control processing of FIG. 2 with processing for determining whether the detected pressure is greater than or equal to prescribed pressure and replaces the content of step S21 in the resumption control processing of FIG. 3 with processing for determining whether the detected pressure is less than the prescribed pressure. Here, the prescribed pressure represents pressure of the secondary-side flow path 42B when the steam from the exhaust-gas economizer 40 is preferentially supplied to the soot blower 50, e.g., the lower-limit value of the pressure of the steam in the secondary-side flow path 42B when the soot blower 50 is used. The prescribed pressure is set in advance according to an examination or the like With the above configuration, effects the same as the effects (1) to (3) of the first embodiment may be obtained.

In addition, when a flow-rate sensor 71 is provided in the secondary-side flow path 42B, it may be grasped the flow state of the steam in the secondary-side flow path 42B and by extension may indirectly be grasped the supply state of the steam from the exhaust-gas economizer 40 to the soot blower 50 based on a flow rate detected by the flow-rate sensor 71. Thus, the controller 19 may perform the stop control and the resumption control based on the flow rate (detected flow rate) of the secondary-side flow path 42B. The controller 19 replaces the content of step S11 in the stop control processing of FIG. 2 with processing for determining whether the detected flow rate is greater than or equal to a prescribed flow rate and replaces the content of step S21 in the resumption control processing of FIG. 3 with processing for determining whether the detected flow rate is less than the prescribed flow rate. Here, the prescribed flow rate represents a flow rate of the secondary-side flow path 42B when the steam from the exhaust-gas economizer 40 is preferentially supplied to the soot blower 50, i.e., the lower-limit value of a steam amount in the secondary-side flow path 42B when the soot blower 50 is used. The prescribed flow rate is set in advance according to an examination or the like. With the above configuration, effects the same as the effects (1) to (3) of the first embodiment may be obtained.

In the third embodiment, a temperature sensor or a flow-rate sensor 72 may be provided in the second steam flow path 43 instead of the pressure sensor 54. With a pressure sensor provided in the second steam flow path 43, it may be grasped the flow state of the steam in the second steam flow path 43 and by extension may indirectly be grasped the supply state of the steam from the exhaust-gas economizer 40 to the second heater 13 based on a temperature detected by the temperature sensor. Thus, the controller 19 may perform the stop control and the resumption control based on the temperature (detected temperature) of the steam in the second steam flow path 43. Then, the controller 19 replaces the content of step S51 in the stop control processing of FIG. 8 with processing for determining whether the detected temperature is less than a prescribed temperature and replaces the content of step S62 in the resumption control processing of FIG. 9 with processing for determining whether the detected temperature is greater than or equal to the prescribed temperature. Here, the prescribed temperature represents a temperature in the second steam flow path 43 when the steam from the exhaust-gas economizer 40 is preferentially supplied to the soot blower 50, e.g., the lower-limit value of the temperature of the steam in the second steam flow path 43 when the soot blower 50 is used. The prescribed temperature is set in advance according to an examination or the like. With the above configuration, effects equivalent to the effects (6) and (7) of the third embodiment may be obtained.

In addition, when a flow-rate sensor 72 is provided in the second steam flow path 43, it may be grasped the flow state of the steam in the second steam flow path 43 and by extension may indirectly be grasped the supply state of the steam from the exhaust-gas economizer 40 to the second heater 13 based on a flow rate detected by the flow-rate sensor 72. Thus, the controller 19 may perform the stop control and the resumption control based on the flow rate (detected flow rate) of the second steam flow path 43. The controller 19 replaces the content of step S51 in the stop control processing of FIG. 8 with processing for determining whether the detected flow rate is less than or equal to a prescribed flow rate and replaces the content of step S62 in the resumption control processing of FIG. 9 with processing for determining whether the detected flow rate is greater than the prescribed flow rate. Here, the prescribed flow rate represents a flow rate in the second steam flow path 43 when the steam from the exhaust-gas economizer 40 is preferentially supplied to the soot blower 50, i.e., the lower-limit value of a steam amount in the second steam flow path 43 when the soot blower 50 is used. The prescribed flow rate is set in advance according to an examination or the like. With the above configuration, effects equivalent to the effects (6) and (7) of the third embodiment may be obtained.

In the first embodiment, the controller 19 may perform the stop control and the resumption control based on a difference in temperature between the steam in the secondary-side flow path 42B of the first steam flow path 42 and the steam in the second steam flow path 43. In this case, a temperature sensor is provided in the second steam flow path 43.

Specifically, in the stop control, when a value obtained by subtracting a temperature of the steam in the second steam flow path 43 from a temperature of the steam in the secondary-side flow path 42B is greater than or equal to a prescribed value, the controller 19 determines that the steam from the exhaust-gas economizer 40 is preferentially supplied to the soot blower 50 and stops the power generation of the heat energy recovery system 1. In addition, in the resumption control, when a value obtained by subtracting a temperature of the steam in the second steam flow path 43 from a temperature of the steam in the secondary-side flow path 42B is less than the prescribed value, the controller 19 determines that the steam from the exhaust-gas economizer 40 is not supplied preferentially to the soot blower 50 and resumes the operation of the heat energy recovery system 1. Note that the prescribed value represents the lower-limit value of a difference in temperature at which the steam from the exhaust-gas economizer 40 may be determined to be preferentially supplied to the soot blower 50 and that is set in advance according to an examination or the like. Moreover, the controller 19 may perform the stop control and the resumption control based on pressure or flow rates of the steam in the respective paths 42 and 43 instead of a temperature of the steam in the secondary-side flow path 42B and a temperature of the steam in the second steam flow path 43. In this case, a pressure sensor or a flow-rate sensor is provided in the respective paths 42B and 44 according to need. Further, the third embodiment may also be modified in the same way. According to the above modified examples, the controller 19 performs the stop control and the resumption control based on both an index (temperature, pressure, or flow rate) showing the flow state of the steam in the first steam flow path 42 and an index (temperature, pressure, or flow rate), showing the flow state of the steam in the second steam flow path 43.

In the first embodiment, the controller 19 performs the stop control and the resumption control based on one of the indices of a temperature and pressure of the steam in the secondary-side flow path 42B. However, without being limited to this, the controller 19 may be configured to perform the stop control and the resumption control based on a plurality of the indices of a temperature, pressure, and a flow rate of the steam. As an example of such a configuration, the controller 19 stores a two-dimensional map that defines a stop-control performing region for performing the stop control based on a temperature and pressure of the steam in the secondary-side flow path 42B. Then, in a state in which the heat energy recovery system 1 operates, the controller 19 determines whether the operation state of the heat energy recovery system 1 specified by a temperature and pressure of the steam in the secondary-side flow path 42B falls within the stop-control performing region using the two-dimensional map. When determining that the operation state falls within the stop-control performing region, the controller 19 performs the stop control. In addition, in a state in which the operation of the heat energy recovery system 1 has been stopped, the controller 19 determines whether the operation state of the heat energy recovery system 1 falls within the stop-control performing region specified by a temperature and pressure of the steam in the secondary-side flow path 42B using the two-dimensional map. When determining that the operation state does not fall within the stop-control performing region, the controller 19 may perform the resumption control. Note that in the third embodiment as well, the controller 19 may similarly modify the mode of performing the stop control and the resumption control based on a plurality of the indices of a temperature, pressure, and a flow rate of the steam in the second steam flow path 43.

In the respective embodiments and the modified examples, the steam from the exhaust-gas economizer 40 may be supplied to an apparatus other than the soot blower 50. The present invention may be applied to such a configuration provided that there is established a relationship in which the steam supplied to the second heater 13 decreases as the steam supplied to an apparatus other than the second heater 13 increases and in which the steam supplied to the second heater 13 increases as the steam supplied to an apparatus other than tire second heater 13 decreases.

In the stop control processing of the respective embodiments and the modified examples, the controller 19 may perform only stopping of the operation of the circulation pump 11. Even in this way, the power generation of the heat energy recovery system 1 may be stopped.

In the respective embodiments and the modified examples, the return path 45 that supplies the liquefied steam from the second heater 13 to the exhaust-gas economizer 40 may be omitted.

In the respective embodiments and the modified examples, R245fa is used as the working medium flowing into the medium circulation path 20. However, low molecular hydrocarbon such as isopentane, butane, and propane, R134a used as a refrigerant, or the like may be used instead of this.

In the respective embodiments and the modified examples, the controller 19 may perform only the stop control among the stop control and the resumption control, and an operator may manually resume the operation of the circulation pump 11 and close the bypass valve 29. In addition, when determining that the steam is preferentially supplied to a destination that demands the steam based on at least one of the flow state of the steam in the first steam flow path 42 and the flow state of the steam in the second steam flow path 43, the controller 19 may inform an operator of this situation through an alert. The controller 19 performs the stop control when receiving instructions from the operator.

In the respective embodiments and the modified examples, an economizer that generates steam from another heat source in a ship may be used instead of one that generates steam from the exhaust gas of the internal combustion engine 31 like the exhaust-gas economizer 40.

In the respective embodiments and the modified examples, the heat energy recovery system 1 converts heat energy recovered via the working medium into power for the turbine 15 and uses the converted power for the power generation of the generator 16 serving as a power recovery machine. However, the power for the turbine 15 may be used as power for operating an apparatus other than the generator 16. In this case, the apparatus other than the generator 16 corresponds to the power recovery machine.

Here, a description will be given of the general information of the above embodiments.

An embodiment provides a heat energy recovery system that is installed in a ship and recovers heat energy of supercharged air from a supercharger of an internal combustion engine via a working medium while recovering heat energy of steam from an economizer via the working medium under a condition in which the steam is preferentially supplied to a destination that demands the steam in the ship, the heat energy recovery system including: a heat energy recovery circuit having a closed-type medium circulation path in which a first heater that heats the working medium by heat exchange between the supercharged air and the working medium, a second heater that is connected in series to the first heater and heats the working medium by heat exchange between the steam from the economizer and the working medium, an expander that generates power based on expansion of the working medium heated by the first heater and the second heater, a condenser that condenses the working medium flowing out from the expander, and a pump that conveys the working medium from the condenser are connected in sequence; a power recovery machine that is connected to the expander and recovers the power of the expander; a first steam flow path that causes the steam to flow from the economizer to tire destination that demands the steam; a second steam flow path that branches off from the first steam flow path and causes the steam to flow from the economizer to the second heater; and a controller that performs stop control to stop an operation of the pump based on at least one of a flow state of the steam in the first steam flow path and a flow State of the steam in the second steam flow path.

In the configuration, the "destination that demands the steam in the ship" represents an apparatus that is installed in the ship and performs an operation using the steam. Examples of the apparatus include a soot blower that cleans a ballast tank, a cargo room, a deck, or the like.

When most of the steam from the economizer is supplied to the destination that demands the steam in the ship, the steam supplied from the economizer to the second heater decreases, which results in a reduction in the heat energy recovery efficiency of the heat energy recovery system. Accordingly, it is preferable to stop the operation in order to reduce the consumption energy of the heat energy recovery system.

In this regard, according to the configuration, the controller performs the stop control based on the flow state of the steam in the first steam flow path and the flow state of the steam in the second steam flowing path, i.e., the supply state of the steam from the economizer to the destination that demands the steam in the ship and the supply state of the steam from the economizer to the second heater. Thus, when the heat energy recovery efficiency of the heat energy recovery system is reduced, the controller may automatically stop the operation of the pump to stop the operation of the heat energy recovery system. Accordingly, the operation of the heat energy recovery system is reliably stopped at an appropriate timing.

In addition, it is preferable that the heat energy recovery system further includes: an on-off-valve provided on a downstream side with respect to a point at which the second steam flow path branches off from the first steam flow path; and a temperature detection-unit that detects a temperature of the steam on a downstream side with respect to the on-off valve in the first steam flow path, wherein the controller performs the stop control when the temperature detected by the temperature detection unit is greater than or equal to a prescribed temperature at which the steam is determined to be preferentially supplied to the destination that demands the steam.

There is a likelihood that a temperature of the steam in the first steam flow path, i.e., the flow path between the economizer and the destination that demands the steam in the ship becomes high as the amount of the steam that is an index showing the flow state of the steam in the first steam flow path increases when the steam from the economizer starts flowing into the first steam flow path. Then, when the steam from the economizer has substantially flown into the first steam flow path, the steam in the first steam flow path is maintained at a temperature substantially higher than its temperature inside the first steam flow path before the steam from the economizer flows into the first steam flow path.

Since a temperature of the steam in the first steam flow path is detected by the temperature detection unit according to the configuration, the controller may appropriately grasp the situation that the steam is preferentially supplied to the destination that demands the steam based on the comparison result between the detected temperature of the steam and a prescribed temperature. Then, based on the grasped flow state of the steam, the controller may stop the operation of the pump to stop the operation of the heat energy recovery system. Accordingly, the operation of the heat energy recovery system may be stopped at an appropriate timing.

In addition, in the heat energy recovery system, it is preferable that the controller performs resumption control to resume the operation of the pump when the detected temperature decreases to a temperature less than the prescribed temperature in a state in which the operation of the pump has been stopped according to the stop control.

According to the configuration, the controller may resume the operation of the stopped pump after grasping the situation that the destination that demands the steam such as the soot blower does not need the steam based on the comparison result between a detected temperature of the steam and a prescribed temperature. Thus, the controller may resume the operation of the heat energy recovery system at an appropriate timing and prevent an unnecessary reduction in the heat energy recovery efficiency of the heat energy recovery system caused when an operator forgets to perform the resumption operation of the heat energy recovery system or the operator inadvertently delays in performing the resumption operation.

Moreover, it is preferable that the heat energy recovery system further includes: an on-off valve provided on a downstream side with respect to the point at which the second steam flow path branches off from the first steam flow path; and a valve detection unit that detects the opened state and the closed state of the on-off valve, wherein the controller performs the stop control when the opened state of the on-off valve is detected by the valve detection unit.

With the on-off valve provided in the first steam flow path, the steam is supplied from the economizer to the destination that demands the steam in the ship when the on-off valve is opened.

Since the opened state of the on-off valve is detected by the valve detection unit according to the configuration, the controller may grasp the flow state of the steam in the first steam flow path based on the detection result. Accordingly, by stopping the operation of the pomp based or the grasped flow state of the steam, the controller may stop the operation of the heat energy recovery system at an appropriate timing.

Furthermore, in the heat energy recovery system, it is preferable that the controller performs resumption control to resume the operation of the pump when the closed state of the on-off valve is detected in a state in which the operation of the pump has been stopped according to the step control.

According to the configuration, the controller may resume the operation of the stopped pump after grasping the situation that the destination that demands the steam such as the soot blower does not need the steam based on the closed state of the on-off valve. Thus, the controller may resume the operation of the heat energy recovery system at an appropriate timing and prevent an unnecessary reduction in the heat energy recovery efficiency of the heat energy recovery system caused when an operator forgets to perform the resumption operation of the heat energy recovery system or the operator inadvertently delays in performing the resumption operation.

Furthermore, it is preferable that the heat energy recovery system further includes a pressure detection unit that detects pressure of the steam flowing into the second steam flow path, wherein the controller performs the stop control when the pressure detected by the pressure detection unit is less than prescribed pressure at which the steam is determined to be preferentially supplied to the destination that demands the steam.

There is a likelihood that pressure of the steam in the second steam flow path, i.e., the flow path between the economizer and the second heater becomes high as the amount of the steam that is an index showing the flow state of the steam in the second steam flow path increases when the steam from the economizer starts flowing into the second steam flow path. Then, when the steam from the economizer has substantially flown into the second steam flow path, the steam in the second steam flow path is maintained at pressure substantially higher than its pressure inside the second steam flow path before the steam from the economizer flows into the second steam flow path. In addition, when a flow rate of the steam in the second steam flow path increases, a flow rate of the steam in the first steam flow path decreases correspondingly.

Since pressure of the steam in the second steam flow path is detected by the pressure detection unit according to the configuration, the controller may grasp the flow state of the steam in the second steam flow path and the flow state of the steam in the first steam flow path based on the detected pressure. Then, the controller may stop the operation of the pump to stop the operation of the heat energy recovery system after grasping the situation that the steam is preferentially supplied to the destination that demands the steam based on the comparison result between the detected pressure of the steam and prescribed pressure. Accordingly, the operation of the heat energy recovery system may be stopped at an appropriate timing.

Furthermore, in the heat energy recovery system, it is preferable that the controller performs resumption control to resume the operation of the pump when the detected pressure increases to pressure greater than or equal to the prescribed pressure in a state in which the pump has been stopped according to the stop control.

According to the configuration, the controller may resume the operation of the stopped pump after grasping the situation that the destination that demands the steam such as the soot blower does not need the steam based on the comparison result between detected pressure of the steam and prescribed pressure. Thus, the controller may resume the operation of the heat energy recovery system at an appropriate timing and prevent an unnecessary reduction in the heat energy recovery efficiency of the heat energy recovery system caused when an operator forgets to perform the resumption operation of the heat energy recovery system or the operator inadvertently delays in performing the resumption operation.

Furthermore, it is preferable that the heat energy recovery system further includes: an on-off valve provided on a downstream side with respect to a point at which the second steam flow path branches off from the first steam flow path; and a pressure detection unit that detects pressure of the steam on a downstream side with respect to the on-off valve in the first steam flow path, wherein the controller performs the stop control when the pressure detected by the pressure detection unit is greater than or equal to prescribed pressure at which the steam is determined to be preferentially supplied to the destination that demands the steam.

There is a likelihood that pressure of tire steam in the first steam flow path, i.e., the flow path between the economizer and the destination that demands the steam in the ship becomes high as the amount of the steam that is an index showing the flow state of the steam in the first steam flow path increases when the steam from the economizer starts flowing into the first steam flow path. Then, when the steam from the economizer has substantially flown into the first steam flow path, the steam in the first steam flow path is maintained at pressure substantially higher than its pressure inside the first steam flow path before the steam from the economizer flows into the first steam flow path.

Since pressure of the steam in the first steam flow path is detected by the pressure detection unit according to the configuration, the controller may grasp the flow state of the steam in the first steam flow path based on the detected pressure. Then, the controller may stop the operation of the pump to stop the operation of the heat energy recovery system after appropriately grasping the situation that the steam is preferentially supplied to the destination that demands the steam based on the comparison result between the detected pressure of the steam and prescribed pressure. Accordingly, the operation of the heat energy recovery system may be stopped at an appropriate timing.

Furthermore, in the heat energy recovery system, it is preferable that the controller performs resumption control to resume the operation of the pump when the detected pressure decreases to pressure less than the prescribed pressure in a state in which the operation of the pump has been stopped according to the stop control.

According to the configuration, the controller may resume the operation of the stopped pump after grasping the situation that the destination that demands the steam such as the soot blower does not heed the steam based on the comparison result between a detected pressure of the steam and a prescribed pressure. Thus, the controller may resume the operation of the heat energy recovery system at an appropriate timing and prevent an unnecessary reduction in the heat energy recovery efficiency of the heat energy recovery system caused when an operator forgets to perform the resumption operation of the heat energy recovery system or the operator inadvertently delays in performing the resumption operation.

Furthermore, it is preferable that the heat energy recovery system further includes a temperature detection unit that detects a temperature of the steam flowing into the second steam flow path, wherein the controller performs the stop control when the temperature detected by the temperature detection unit is less than a prescribed temperature at which the steam is determined to be preferentially supplied to the destination that demands the steam.

There is a likelihood that a temperature of the steam in the second steam flow path, i.e., the flow path between the economizer and the second heater becomes high as the amount of the steam that is an index showing the flow state of the steam in the second steam flow path increases when the steam from the economizer starts flowing into the second steam flow path. Then, when the steam from the economizer has substantially flown into the second steam flow path, the steam in the second steam flow path is maintained at a temperature substantially higher than its temperature inside the second steam flow path before the steam from the economizer flows into the second steam flow path. In addition, when a flow rate of the steam in the second steam flow path increases, a flow rate of the steam in the first steam flow path decreases correspondingly.

Since a temperature of the steam in the second steam flow path is detected by the temperature detection unit according to the configuration, the controller may grasp the flow state of the steam in the second steam flow path and the flow state of the steam in the first steam flow path based on the detected temperature. Then, the controller may stop the operation of the pump to stop the operation of the heat energy recovery system after grasping the situation that the steam is preferentially supplied to the destination that demands the steam based on the comparison result between the detected temperature of the steam and a prescribed temperature. Accordingly, the operation of the heat energy recovery system may be stopped at an appropriate timing.

Furthermore, in the heat energy recovery system, it is preferable that the controller performs resumption control to resume the operation of the pump when the detected temperature increases to a temperature greater than or equal to the prescribed temperature in a state in which the pump has been stopped according to the stop control.

According to the configuration, the controller may resume the operation of the stopped pump after grasping the situation that the destination that demands the steam such as the soot blower does not need the steam based on the comparison result between a detected temperature of the steam and a prescribed temperature. Thus, the controller may resume the operation of the heat energy recovery system at an appropriate timing and prevent an unnecessary reduction in the heat energy recovery efficiency of the heat energy recovery system caused when an operator forgets to perform the resumption operation of the heat energy recovery system or the operator inadvertently delays in performing the resumption operation.

Furthermore, it is preferable that the heat energy recovery system further includes: an on-off valve provided on a downstream side with respect to a point at which the second steam flow path branches off from the first steam flow path; and a flow-rate detection unit (flow-rate sensor 71) that detects a flow rate of the steam on a downstream side with respect to the on-off valve in the first steam flow path, wherein the controller performs the stop control when the flow rate detected by the flow-rate detection unit (flow-rate sensor 71) is greater than or equal to a prescribed flow rate at which the steam is determined to be preferentially supplied to the destination that demands the steam.

There is a likelihood that a flow rate of the steam in the first steam flow path, i.e., the flow path between the economizer and the destination that demands the steam in the ship increases as the amount of the steam that is an index showing the flow state of the steam in the first steam flow path increases.

Since a flow rate of the steam in the first steam flow path is detected by the flow-rate detection unit (flow-rate sensor 71) according to the configuration, the controller may grasp the flow state of the steam in the first steam flow path based on the detected flow rate. Then, the controller may stop the pump to stop the operation of the heat energy recovery system after appropriately grasping the situation that the steam is preferentially supplied to the destination that demands the steam based on the comparison result between the detected flow rate of the steam and a prescribed flow rate. Accordingly, the operation of the heat energy recovery system may be stopped at an appropriate timing.

Furthermore, in the heat energy recovery system, it is preferable that the controller performs resumption control to resume the operation of the pump when the detected flow rate decreases to a flow rate less than the prescribed flow rate in a state in which the operation of the pump has been stopped according to the stop control.

According to the configuration, the controller may resume the operation of the stopped pump after grasping the situation that the destination that demands the steam such as the soot blower does not need the steam based on the comparison result between a detected flow rate of the steam and a prescribed flow rate. Thus, the controller may resume the operation of the heat energy recovery system at an appropriate timing and prevent an unnecessary reduction in the heat energy recovery efficiency of the heat energy recovery system caused when an operator forgets to perform the resumption operation of the heat energy recovery system or the operator inadvertently delays in performing the resumption operation.

Furthermore, it is preferable that the heat energy recovery system further includes: a flow-rate detection unit (flow-rate sensor 72) that detects a flow rate of the steam flowing into the second steam flow path, wherein the controller performs the stop control when the flow rate defected by the flow-rate detection unit (flow-rate sensor 72) is less than a prescribed flow rate at which the steam is determined to be preferentially supplied to the destination that demands the steam.

There is a likelihood that a flow rate of the steam in the second steam flow path, i.e., the flow path between the economizer and the second heater increases as the amount of the steam that is an index showing the flow state of the steam in the second steam flow path increases. In addition, when a flow rate of the steam in the second steam flow path increases, a flow rate of the steam in the first steam flow path decreases correspondingly.

Since a flow rate of the steam in the second steam flow path is detected by the flow-rate detection unit (flow-rate sensor 72), the controller may grasp the flow state of the steam in the second steam flow path and the flow-state of the steam in the first steam flow path based on the detected flow rate. Then, the controller may stop the operation of the pump to stop the operation of the heat energy recovery system after grasping the situation that the steam is preferentially supplied to the destination that demands the steam based on the comparison result between the detected flow rate of the steam and a prescribed flow rate. Accordingly, the operation of the heat energy recovery system may be stopped at an appropriate timing.

Furthermore, in the heat energy recovery system, it is preferable that the controller performs resumption control to resume the operation of the pomp when the detected flow rate increases to a flow rate greater than or equal to the prescribed flow rate in a state in which the pump has been stopped according to the stop control.

According to the configuration, the controller may resume the operation of the stopped pump after grasping the situation that the destination that demands the steam such as the soot blower does not need the steam based on the comparison result between a detected flow rate of the steam and a prescribed flow rate. Thus, the controller may resume the operation of the heat energy recovery system at an appropriate timing and prevent an unnecessary reduction in the heat energy recovery efficiency of the heat energy recovery system caused when an operator forgets to perform the resumption operation of the heat energy recovery system or the operator inadvertently delays in performing the resumption operation.

Furthermore, in the heat energy recovery system, it is preferable that the controller invalidates the stop control when the internal combustion engine has a load greater than or equal to a setting load.

As described above, the steam supplied from the economizer to the second heater decreases when the steam is supplied from the economizer to the destination that demands the steam in the ship on a large scale. Therefore, an increasing amount of the temperature of the working medium in the second heater reduces. Even in this case, supercharged pressure of the supercharger becomes high and a temperature of supercharged air becomes high when the internal combustion engine has a high load. Therefore, the first heater may substantially increase the temperature of the working medium with the heat of the high-temperature supercharged air, whereby the power recovery of the power recovery machine can be expected.

According to the configuration, the controller invalidates the stop control when the internal combustion engine has a load greater than or equal to the setting load at which the internal combustion engine is determined to have a high load. Therefore, an unnecessary reduction in the heat energy recovery efficiency of the heat energy recovery system may be prevented.

Furthermore, in the heat energy recovery system, it is preferable that the second heater recovers latent heat of the steam through heat exchange with the working medium and has a return path to return the steam ejected from the second heater to the economizer.

According to the configuration, the second heater recovers the latent heat of the steam from the economizer, and the steam ejected from the second heater returns to the economizer via the return path. Therefore, an atmos condenser is not needed, and the simplification of the configuration of the heat energy recovery system may be attained.

Furthermore, it is preferable that the heat energy recovery system further includes a detouring unit that causes the working medium to flow while detouring around the power recovery machine, wherein the controller controls the detouring unit such as to cause the working medium to detour around the power recovery machine in the stop control.

According to the configuration, the working medium flows while detouring around the expander and the power recovery machine, and the pressure less of the working medium reduces when the working medium flows into the medium circulation path. Therefore, the ejection pressure of the pump reduces. Accordingly, when the working medium is caused to flow while detouring around the expander and the power recovery machine with the operation of the pump, consumption energy of the pump is reduced.

This application is based on Japanese Patent application No. 2015-080238 filed in Japan Patent Office on Apr. 9, 2015, the contents of which are hereby incorporated by reference.

Although the present invention has been fully described by way of example with reference to the accompanying drawings, it is to be understood that various changes and modifications wall be apparent to those skilled in the art. Therefore, unless otherwise such changes and modifications depart from the scope of the present invention hereinafter defined, they should be construed as being included therein.

The invention claimed is:

1. A heat energy recovery system that is installed in a ship and recovers heat energy of supercharged air from a supercharger of an internal combustion engine via a working medium while recovering heat energy of steam from an economizer via the working medium under a condition in which the steam is supplied to a soot blower, that demands the steam in the ship, the heat energy recovery system comprising:

a heat energy recovery circuit having a closed-type medium circulation path in which a first heater that heats the working medium by heat exchange between the supercharged air and the working medium, a second heater that is connected in series to the first heater and heats the working medium by heat exchange between the steam from the economizer and the working medium, an expander that generates power based on expansion of the working medium heated by the first heater and the second heater, a condenser that condenses the working medium flowing out from the expander, and a pump that conveys the working medium from the condenser are connected in sequence;

a power recovery machine that is connected to the expander and recovers the power of the expander;

a first steam flow path that causes the steam to flow from the economizer to the soot blower that demands the steam;

a second steam flow path that branches off from the first steam flow path and causes the steam to flow from the economizer to the second heater; and a controller that performs stop control to stop an operation of the pump based on at least one of a flow state of the steam in the first steam flow path and a flow state of the steam in the second steam flow path, wherein said flow state of the steam includes at least one of a temperature, a pressure, and flow rate of the steam in the first stream flow path or in the second steam flow path, detected by at least one detection unit.

2. The heat energy recovery system according to claim 1, further comprising:

an on-off valve provided on a downstream side with respect to a point at which the second steam flow path branches off from the first steam flow path; and the at least one detection unit including a temperature detection unit that detects a temperature of the steam on a downstream side with respect to the on-off valve in the first steam flow path, wherein the controller performs the stop control when the temperature detected by the temperature detection unit is greater than or equal to a predetermined temperature at which the steam is determined to be supplied to the soot blower that demands the steam.

3. The heat energy recovery system according to claim 2, wherein the controller performs resumption control to resume the operation of the pump when the detected temperature decreases to a temperature less than the predetermined temperature in a state in which the operation of the pump has been stopped according to the stop control.

4. The heat energy recovery system according to claim 1, further comprising:

an on-off valve provided on a downstream side with respect to a point at which the second steam flow path branches off from the first steam flow path; and the at least one detection unit including a valve detection unit that detects an opened state and a closed state of the on-off valve, wherein the controller performs the stop control when the opened state of the on-off valve is detected by the valve detection unit.

5. The heat energy recovery system according to claim 4, wherein the controller performs resumption control to resume the operation of the pump when the closed state of the on-off valve is detected in a state in which the operation of the pump has been stopped according to the stop control.

6. The heat energy recovery system according to claim 1, wherein the at least one detection unit includes a pressure detection unit detecting a pressure of the steam flowing into the second steam flow path; and wherein the controller performs the stop control when the pressure detected by the pressure detection unit is less than predetermined pressure at which the steam is determined to be supplied to the soot blower that demands the steam.

7. The heat energy recovery system according to claim 6, wherein the controller performs resumption control to resume the operation of the pump when the detected pressure increases to pressure greater than or equal to the predetermined pressure in a state in which the pump has been stopped according to the stop control.

8. The heat energy recovery system according to claim 1, further comprising:

an on-off valve provided on a downstream side with respect to a point at which the second steam flow path branches off from the first steam flow path;

wherein the at least one detection unit includes a pressure detection unit detecting a pressure of the steam on a downstream side with respect to the on-off valve in the first steam flow path; and wherein the controller performs the stop control when the pressure detected by the pressure detection unit is greater than or equal to predetermined pressure at which the steam is determined to be supplied to the soot blower that demands the steam.

9. The heat energy recovery system according to claim 8, wherein the controller performs resumption control to resume the operation of the pump when the detected pressure decreases to pressure less than the predetermined pressure in a state in which the operation of the pump has been stopped according to the stop control.

10. The heat energy recovery system according to claim 1, wherein the at least one detection unit includes a temperature detection unit detecting a temperature of the steam flowing into the second steam flow path; and wherein the controller performs the stop control when the temperature detected by the temperature detection unit is less than a predetermined temperature at which the steam is determined to be supplied to the soot blower that demands the steam.

11. The heat energy recovery system according to claim 10, wherein the controller performs resumption control to resume the operation of the pump when the detected temperature increases to a temperature greater than or equal to the predetermined temperature in a state in which the pump has been stopped according to the stop control.

12. The heat energy recovery system according to claim 1, further comprising:

an on-off valve provided on a downstream side with respect to a point at which the second steam flow path branches off from the first steam flow path;

wherein the at least one detection unit includes a flow-rate detection unit detecting a flow rate of the steam on a downstream side with respect to the on-off valve in the first steam flow path; and wherein the controller performs the stop control when the flow rate detected by the flow-rate detection unit is greater than or equal to a predetermined flow rate at which the steam is determined to be supplied to the soot blower that demands the steam.

13. The heat energy recovery system according to claim 12, wherein the controller performs resumption control to resume the operation of the pump when the detected flow rate decreases to a flow rate less than the predetermined flow rate in a state in which the operation of the pump has been stopped according to the stop control.

14. The heat energy recovery system according to claim 1, wherein the at least one detection unit includes a flow-rate detection unit detecting a flow rate of the steam flowing into the second steam flow path; and wherein the controller performs the stop control when the flow rate detected by the flow-rate detection unit is less than a predetermined flow rate at which the steam is determined to be supplied to the soot blower that demands the steam.

15. The heat energy recovery system according to claim 14, wherein the controller performs resumption control to resume the operation of the pump when the detected flow rate increases to a flow rate greater than or equal to the predetermined flow rate in a state in which the pump has been stopped according to the stop control.

16. The heat energy recovery system according to claim 1, wherein the controller invalidates the stop control when the internal combustion engine has a load greater than or equal to a setting load.

17. The heat energy recovery system according to claim 1, wherein the second heater recovers latent heat of the steam through heat exchange with the working medium, the heat energy recovery system further comprising a return path to return the steam ejected from the second heater to the economizer.

18. The heat energy recovery system according to claim 1, further comprising:

a detouring unit that causes the working medium to flow while detouring around the power recovery machine, wherein the controller controls the detouring unit to detour the working medium around the power recovery machine during the stop control.

19. A heat energy recovery system that is installed in a ship and recovers heat energy of supercharged air from a supercharger of an internal combustion engine via a working medium while recovering heat energy of steam from an economizer via the working medium under a condition in which the steam is supplied to a soot blower, that demands the steam in the ship, the heat energy recovery system comprising:

a heat energy recovery circuit having a closed-type medium circulation path in which a first heater that heats the working medium by heat exchange between the supercharged air and the working medium, a second heater that is connected in series to the first heater and heats the working medium by heat exchange between the steam from the economizer and the working medium, an expander that generates power based on expansion of the working medium heated by the first heater and the second heater, a condenser that condenses the working medium flowing out from the expander, and a pump that conveys the working medium from the condenser are connected in sequence;

a power recovery machine that is connected to the expander and recovers the power of the expander;

a first steam flow path that causes the steam to flow from the economizer to the soot blower that demands the steam;

a second steam flow path that branches off from the first steam flow path and causes the steam to flow from the economizer to the second heater;

a controller that performs stop control to stop an operation of the pump based on at least one of a flow state of the steam in the first steam flow path and a flow state of the steam in the second steam flow path;

an on-off valve provided on a downstream side with respect to a point at which the second steam flow path branches off from the first steam flow path; and a temperature detection unit that detects a temperature of the steam on a downstream side with respect to the on-off valve in the first steam flow path, wherein the controller performs the stop control when the temperature detected by the temperature detection unit is greater than or equal to a predetermined temperature at which the steam is determined to be supplied to the soot blower that demands the steam.

* * * * *